United States Patent [19]

Rousselle, Jr.

[11] 4,307,678

[45] Dec. 29, 1981

[54] HYDRAULIC QUICK RELEASE SYSTEM FOR TUB/BARGE CONNECTIONS

[76] Inventor: Birney A. Rousselle, Jr., #9 Carriage La., Algiers, La. 70114

[21] Appl. No.: 891,703

[22] Filed: Mar. 30, 1978

[51] Int. Cl.[3] ..... B63B 21/04

[52] U.S. Cl. ..... 114/251; 114/246; 114/247; 114/248

[58] Field of Search ..... 114/150, 242, 247, 248, 114/253, 254, 246, 249, 251; 254/172, 173R, 173 A, 173 B, 174, 175

[56] References Cited

U.S. PATENT DOCUMENTS

| | | | |
|---|---|---|---|
| 2,892,310 | 6/1959 | Mercier | 114/150 X |
| 3,132,622 | 5/1964 | Hackenberger | 114/254 |
| 3,461,829 | 8/1969 | Mosvold | 114/246 |
| 3,508,400 | 4/1970 | Mercier | 114/150 X |
| 3,576,170 | 4/1971 | Bush | 114/253 |
| 3,645,225 | 2/1972 | Lunde | 114/249 |
| 3,842,781 | 10/1974 | Kikui | 114/254 X |
| 4,026,234 | 5/1977 | Zbilut et al. | 114/248 |
| 4,072,122 | 2/1978 | Balston | 114/253 X |

FOREIGN PATENT DOCUMENTS

| | | | |
|---|---|---|---|
| 2430468 | 1/1976 | Fed. Rep. of Germany | 114/254 |

*Primary Examiner*—Trygve M. Blix
*Assistant Examiner*—D. W. Keen
*Attorney, Agent, or Firm*—C. Emmett Pugh and Associates

[57] ABSTRACT

A hydraulic quick release system for tightening and releasing tug and barge cable connections in the event of a breakage of a cable. The system comprises a novel hydraulic circuit comprising a pair of hydraulic cylinders mounted on the stern of the tug with apparatus for attaching the barge cable connections to the hydraulic cylinders. Each cylinder has an apparatus for actuating the cylinders simultaneously and independent of each other to tighten and loosen the cable connections. There is provided in the system by-passing apparatus whereby each cylinder may be independently actuated as required by conditions. Controlling apparatus permit the cylinders to be quickly actuated to tighten and loosen the barge cable connections as desired with apparatus being provided for increasing the extending speed of the cylinders in order that the cables can be quickly released from the cylinders by a quick extending thereof. A pilot-operated check valve and in-line check valve provide a regenerative system which is utilized for increasing the extending speed of the cylinder for releasing the cable without other pumps or increasing the horsepower of the unit. In a modification there is provided manual control apparatus associated with an auxiliary pump for controlling the system in an emergency generator failure.

In a modification of the preferred embodiment there is further provided a further safety feature to the system comprising an auxiliary pump accessory drive off of the tugs tow winch engine or other engine which is connected to the hydraulic sump of the system and operatively connected to the hydraulic cylinders with manual control means associated with the auxiliary pump for controlling the hydraulic fluid from the pump to the hydraulic cylinders in an emergency generator failure in event that the basic actuating means of the invention fails.

9 Claims, 7 Drawing Figures

HYDRAULIC QUICK RELEASE SYSTEM FOR TUB/BARGE CONNECTIONS

BACKGROUND OF THE INVENTION

This invention relates generally to hydraulic systems and more particularly to a new and novel improved quick release system for tightening and releasing tug and barge cable connections during the normal operation of the tug and also during emergency conditions.

In the operation of a tug utilized in handling a single barge unit, the tug is generally positioned in a notch in the stern of the barge unit with two cables, one of each side, connecting the stern of the tug to the barge unit. It is highly desirable to be able to tighten these cables periodically as the barge is being towed and also in the event of an emergency or upon normal release conditions to be able to quickly release the cables from the tug.

Prior art hydraulic systems for releasing the cables from the barges generally included the use of electric operated spool valves connected in common to a pair of hydraulic pumps which actuated the respective cylinders one at a time and in a very slow manner. Such prior art systems, while satisfactory for some conditions, were not generally satisfactory for emergency conditions wherein it is highly desirable to be able to quickly release one cable from the tug in the event that the opposite cable breaks. This condition can be very dangerous to the tug operator and the other persons on the tug boat because if the break occurs whenever the tug is pushing the single barge, the barge will actually pull the tug and possibly turn it over or make it list at a dangerous angle in the water.

Such prior art systems also generally had no fail-safe feature in that, if the generator on the tug developed troubles and went out of commission, no auxiliary system was provided to enable the cables to be released from the barge during normal operations or in an emergency. In order to release the cables under these conditions, the deck hands would have to proceed to the back deck of the tug and handle various manual valves in order to manually release the cables, requiring them to work at times in water up to their waist in order to get the tug loose from the barge.

SUMMARY DISCUSSION OF THE INVENTION

In order to overcome the problems inherent in the prior art hydraulic systems, there has been provided by the subject invention, a new and novel improved hydraulic quick release system for tightening and releasing tug and barge cable connections wherein a pair of hydraulic cylinders are controlled by a pair of electric pilot operated control valves with provision being made in the system for cross connection between the two hydraulic cylinders in the form of a pair of selector valves allowing the cylinders to be operated independently as desired under various emergency or unusual conditions.

In addition there is provided in the subject invention a means for increasing the extending speed of the cylinder so that, whenever desired, the cables can be quickly released from the cylinders under emergency conditions; and the cables can also be released under the same emergency conditions in the event that the main hydraulic pumps of the system are out of commission by the use of an auxiliary pump and engine operatively connected to manual control valves to manually control the flow of hydraulic fluid from the hydraulic sump of the system to the hydraulic cylinders.

By utilizing the new and novel improved hydraulic system of the present invention the hydraulic cylinders can be synchronized so that the cables on both sides of the tug can be tightened or loosened simultaneously, or, alternately, the cables can be handled independently of each other. The cables under the present system can be released as fast or faster than they can be tightened up, providing improved safety features allowing the captain of the tug to be able to dump the cables simply by hitting a control button on the control panel, whereupon the cables may be released in an average time of twenty-six seconds compared to prior art release time of three to four minutes. With a 5.6 ft. stroke on the cylinders, a retraction time of 1.5 minutes can be obtained to tighten the wires. In addition, the extension of the cylinders with the same stroke can be accomplished in 26 seconds to release the wires. As has been mentioned before the cables can be released in this fast time simultaneously, whereas under prior art systems the cables could not be released together and each had to be released independently of the other.

Accordingly it is an object and advantage of the invention to be able to provide a new and improved hydraulic quick release system for use in controlling the release time of releasing the cables between the tug and the barge simultaneously and independently if desired using a pilot operated check valve and in-line check valve in a regenerative system.

Another object and advantage of the invention is to provide a new and improved hydraulic quick release system using a selector valve arrangement which has improved fail-safe features providing for an auxilliary means to quickly release cables from the tug whenever the main system fails for various reasons.

Another object is to provide an accessory drive pump unit on the tow engine to give mechanical backup to the overall system.

Still yet another object and advantage of the invention is to provide a means within the hydraulic system for quickly being able to extend the respective cylinders in order to be able to quickly release the cables connecting the tug and barges together.

A further object is to provide a hydraulic system using an accumulator with a restrictor to give a surge damper on the wires which enables pushing a barge in rough seas.

Still yet another object and advantage of the invention is to allow the towline to be connected to the barge at all times in case of rough seas or in an emergency which eliminates using the tow winch to make up the tow.

These and other objects and advantages of the invention will become apparent from a study of the drawings hereof and from a review of the description of the preferred embodiments given hereinafter.

DESCRIPTION OF THE PREFERRED EMBODIMENTS

Introduction

Figure 1:
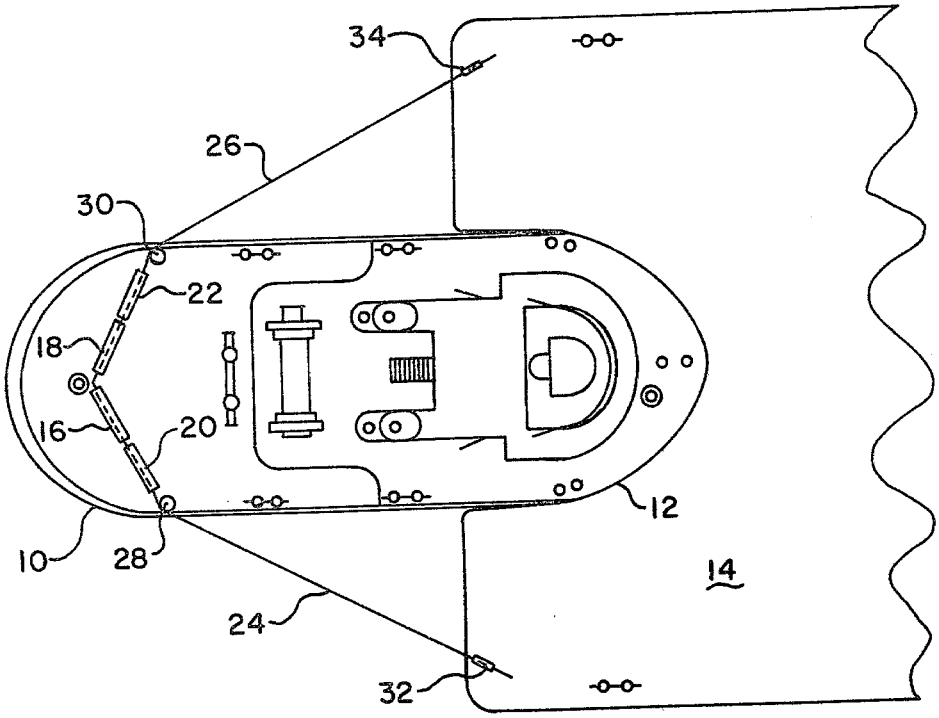
FIG. 1 is a partial, plan view of a tug showing its manner of connection to the stern of the barge by means of a plurality of cable connections to the stern of the tug.

Referring now to the drawings in general and in particular to FIG. 1 of the drawings, there is shown a partial, plan view of a tug 10 showing the tug 10 positioned in a notch 12 formed in the stern of the barge 14 of a single barge. The tug 10 has mounted on the stern thereof a pair of hydraulic cylinders 16 and 18 in proximity to a pair of slide boxes 20 and 22. The slide boxes 20 and 22 contain quick release means for attaching the barge cable connections to the hydraulic cylinders 16 and 18 so that the cables can be quickly and easily attached and released automatically from the cylinders as desired whenever the cylinders are actuated. The slide boxes 20 and 22 form no portion of the subject invention and their inner details will not be described in this application for purposes of brevity and it will be sufficient to say that, whenever the hydraulic cylinders 16 and 18 are actuated, the mechanism in the slide boxes 20 and 22 will either release the cables 24 and 26 from the hydraulic cylinders 16 and 18 or will allow the cables to be tightened as desired so that the tug 10 may be positioned snugly within the notch 12.

The cables 24 and 26 are positioned around a base stand 28 and 30 and are fixedly attached to the barge 14 at locations 32 and 34 by means well known in the art and forming no part of the subject invention.

Prior Art

Figure 2:
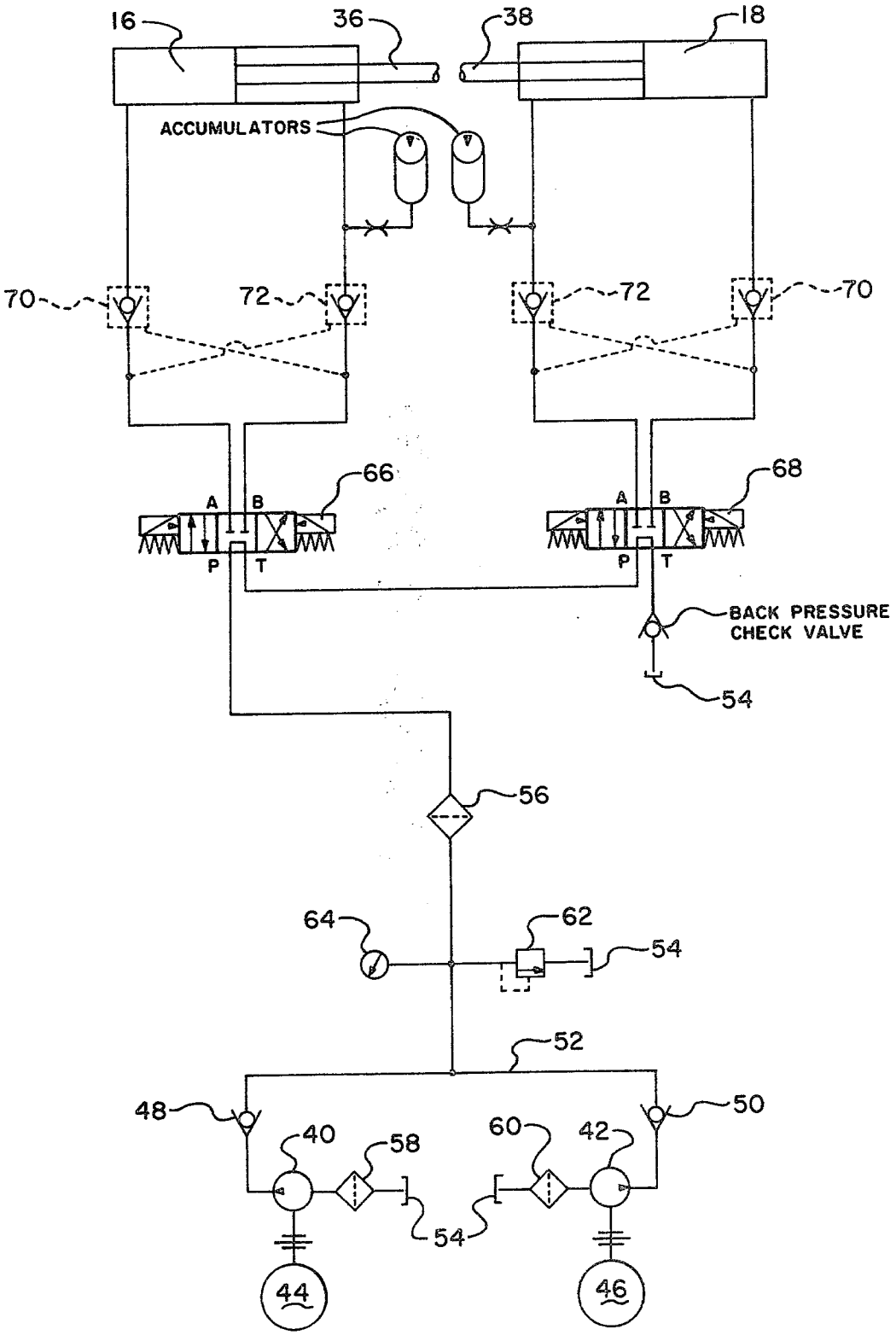
FIG. 2 is a schematic showing a typical prior art hydraulic release system utilized on tugs for releasing the cables from the barges.

Referring now to FIG. 2 of the drawings, there can be seen a schematic of a typical prior art hydraulic release system for use with the tug and barge connection shown in FIG. 1 of the drawing. The hydraulic cylinders 16 and 18 contain rods 36 and 38 which are attached to the slide boxes 20 and 22 as previously mentioned, and the hydraulic cylinders 16 and 18 are operatively connected to a pair of hydraulic pumps 40 and 42 controlled respectively by electric motors 44 and 46.

The hydraulic pumps 40 and 42 are connected in line to a pair of check valves 48 and 50 and are then manifolded together by means of the pipe manifold 52 to allow a given quantity of oil to pass from the sump 54 to the hydraulic cylinders 16 and 18. A typical quantity of hydraulic oil pumped by a system such as this would be in the neighborhood of thirty gallons of hydraulic oil per minute, which passes through an in line filter 56 after having previously passed through a pair of in line filters 58 and 60 prior to being pumped by the hydraulic pumps 40 and 42. A relief valve 62 and a pressure gauge 64 complete the connections at the hydraulic pump units 40 and 42.

In order to control the relative positions of the hydraulic cylinders 16 and 18, there is provided in the prior art system a pair of electric operated solenoid valves 66 and 68 which allow for a positioning or retraction of the respective hydraulic cylinders 16 and 18 as desired according to the position of the solenoid valves. It can be seen from the circuitry that only one hydraulic cylinder, either hydraulic cylinder 16 or hydraulic cylinder 18, can be positioned or retracted at a single time, and in no event can the cylinders 16 and 18 be quickly retracted as a result of the utilization of the two pilot operated, check valves 70 and 72 positioned directly in the hydraulic lines to the hydraulic cylinders 16 and 18. The hydraulic cylinder having the lighter load would always move before the other cylinder providing no synchronization of the cylinders whatsoever. The pilot checks were utilized to keep the control valves from letting the system leak down since all control valves have a tendency to leak slowly.

Invention

Figure 3:
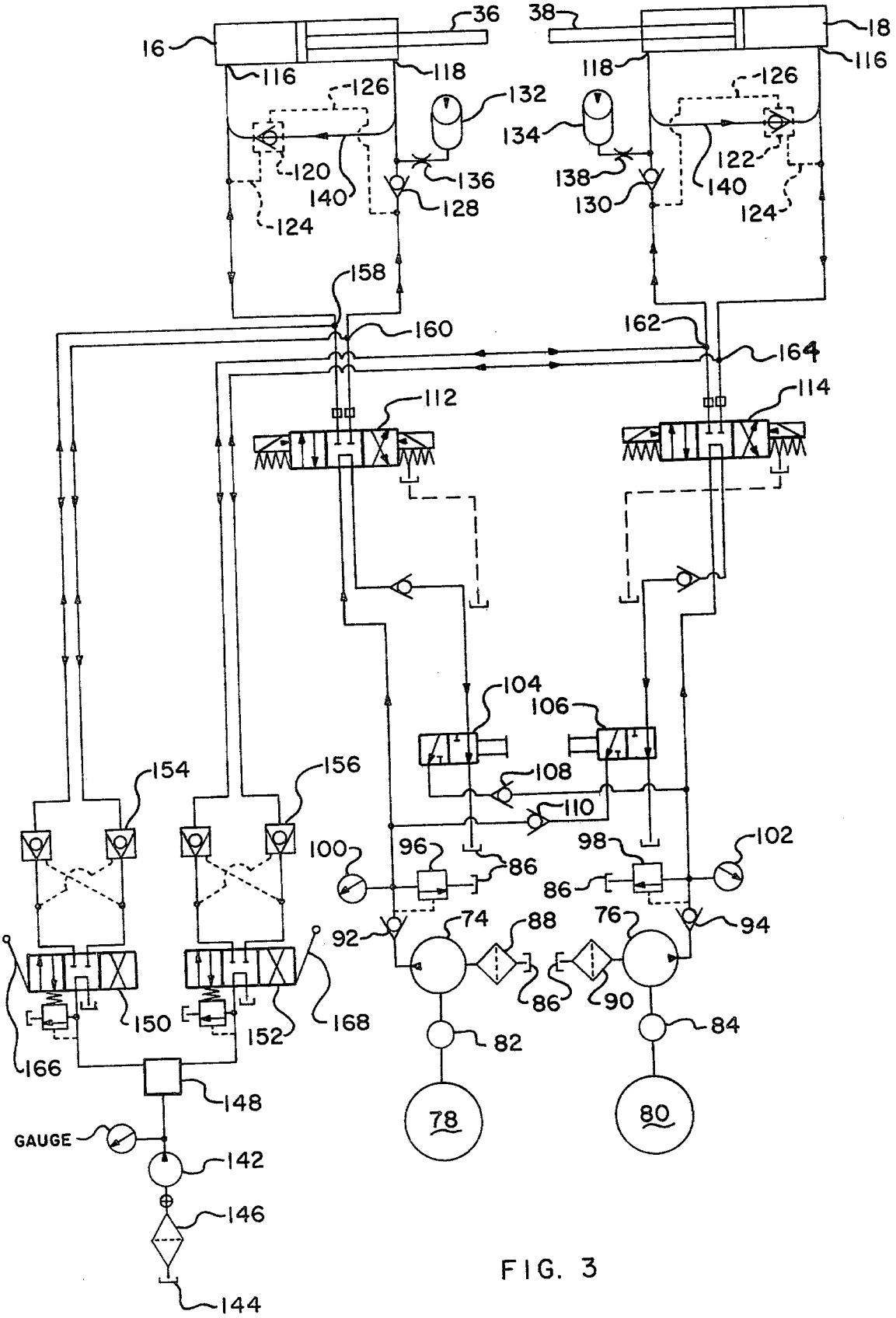
FIG. 3 is a schematic of the preferred embodiment of the subject invention to be described hereinafter.

Referring now to FIG. 3 of the drawings, there is shown a schematic of the applicant's new and novel improved hydraulic, quick release system for quickly positioning or extending hydraulic cylinders 16 and 18 as before mentioned. Also as before mentioned the hydraulic cylinders 16 and 18 are constructed with a pair of rods 36 and 38 which connect to the slide boxes 20 and 22 as shown in FIG. 1 of the drawing.

In the preferred embodiment of applicant's new and novel hydraulic system a pair of hydraulic pumps 74 and 76 are connected to a pair of twenty horsepower electric motors 78 and 80 by means of a standard, mechanical, flexible, motor coupling 82 and 84. The hydraulic pumps 74 and 76 are connected to the sump 86 through a plurality of filters 88 and 90 and are connected at the other end thereof to a pair of in line check valves 92 and 94. A pair of relief valves 96 and 98 along with a pair of pressure gauges 100 and 102 complete the hydraulic apparatus at the hydraulic pump location.

As has been before mentioned, the applicant's new and novel quick release hydraulic system contains means for bypassing the independent actuation of each cylinder by the utilization of a pair of selector valves 104 and 106 cross-connected between the hydraulic pumps 74 and 76 through a pair of check valves 108 and 110. As can be seen from the schematic circuitry, in the event that either the electric motor 78 or the electric motor 80 is lost for various reasons, the other electric motor will be able to operate to selectively control the hydraulic cylinders 16 and 18 at a slower speed than normal independently by transferring hydraulic oil from one pump to the other through the respective selector valve 104 and 106 as a fail-safe feature for the system.

The flow of hydraulic oil from the hydraulic pump 74 and 76 is normally controlled by means of a pair of electric, pilot operated control valves 112 and 114 (positioned as shown in the schematic of FIG. 3) which are connected respectively to the blind side 116 and the working end 118 of the cylinders 16 and 18. The electric, pilot-operated, control valves 112 and 114 (see also FIG. 4) form the means for controlling the actuation of the hydraulic cylinders 16 and 18 so that the cylinders can be actuated to tighten the barge cable connections and also to loosen the connections quickly and easily, as desired.

In order to increase the extending speed of the cylinders 16 and 18, there is provided in a close location to the hydraulic cylinders 16 and 18, a pair of pilot-operated, check valves 120 and 122, which are connected to the blind side 116 of the cylinders 16 and 18 by means of the hydraulic line 124 and are connected to the working end 118 of the cylinders 16 and 18 by means of the hydraulic line 126 downstream of the check valves 128 and 130, all as shown in the schematic in FIG. 3.

Completing the hydraulic circuitry at the cylinder locations on the tug, are a pair of accumulators 132 and 134 connected to a pair of restricting flow control valves 136 and 138 for the express purpose of regulating the pressure differential between the accumulator and the respective cylinder. Due to the various types of seas which the tug and barge may be operated on, the flow control valves 136 and 138 can be adjusted to give a smoother operation of the hydraulic system as desired. (See also FIG. 5A.) This allows the cylinder to damper the surge on the cables to keep them from breaking and lightening the load on the push rigging. There is also provided between the blind side 116 and the working end 118 of the hydraulic cylinders 16 and 18 a regeneration line 140 connecting to the pilot-operated, check valves 120 and 122, in the manner shown in the schematic, which serves as a means to increase the speed of the extending of the respective cylinders in order to be able to quickly get rid of the cable in emergency conditions. By the use of the regeneration lines 140, the hydraulic cylinders 16 and 18 are able to quickly pass the oil from the working end 118 of the cylinders to the blind side 116 of the cylinders, to thereby be able to quickly release the cables in an average time of approximately twenty-six seconds as compared to prior art average times of three to four minutes utilizing prior art systems. This extension time of twenty-six seconds with a retraction time of one and a half minutes is an important improvement over the prior art systems.

Referring now to the left portion of the schematic shown in FIG. 3, there is shown a further improvement of the subject new and novel hydraulic system whereby an auxiliary engine driven pump 142 is utilized to provide further fail-safe features to the system. The auxiliary engine drive pump 142 would be the type of pump that has twice the capacity of motor driven pumps and is driven by two winch engine accessory drives. The pump 142 is connected to a sump 144 through an in line filter 146. The flow from the auxiliary pump 142 would be directed to a 50/50 flow regulator 148 (also see FIG. 5) and would then be divided to pass to two, in line, mechanically operated, lever valves 150 and 152. The lever valves 150 and 152 would be connected to a pair of dual, pilot operated, check valves 154 and 156, in the manner shown in the schematic, which are utilized to prevent any back pressure from passing to the mechanical lever valves 150 and 152. The flow from the dual, pilot-operated, check valve 154 is connected to the basic hydraulic system at points 158 and 160 as shown in the schematic, and in a like manner the flow from the dual pilot-operated, check valve 156 is connected to the hydraulic circuitry at the points 162 and 164 for the hydraulic cylinder 18.

When connected thusly, it can be seen that, in the event of a failure of the basic hydraulic pumps 74 and 76 or the electric motors 78 and 80 or the tug electrical supply, the engine driven, tow winch engine may be utilized to drive the auxiliary pump 142 and the mechanical lever valves 150 and 152 may be mechanically actuated by a crew member in order to tighten or release the respective cables. The emergency procedure in using the auxiliary system would be to start up the tow winch engine and then place the two mechanical levers 166 and 168 in the extend mode, which would thereby automatically loosen the tug from the barge as the mechanical lever valves 150 and 152 are mechanically positioned.

From this it can be seen that the auxiliary system can then be utilized for manually controlling the flow of hydraulic fluid from the sump 144 to the hydraulic cylinders 16 and 18 in an emergency in the event that, for example, the basic actuating means in the form of the motor operated pumps 74 and 76 fail under operating conditions.

Figure 4:
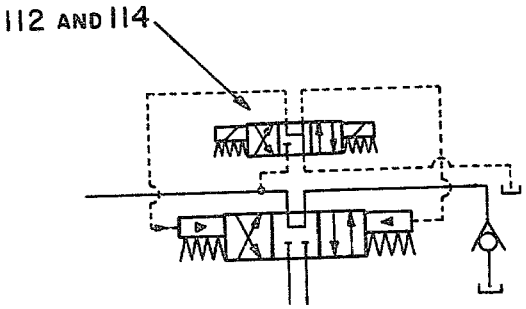
FIG. 4 is a schematic of the electric operated, pilot operated, four way control valve utilized in the system.

Referring now to FIG. 4, there is shown the electrically operated, pilot-operated, four way control valves 112 and 114 of FIG. 3 with a tandem spool having the A and B port blocked in neutral which was used on the original unit converted to the present system. The applicants complete system utilizes opened spooled valves which can pilot pressure the check valve for faster action.

Figure 5A:
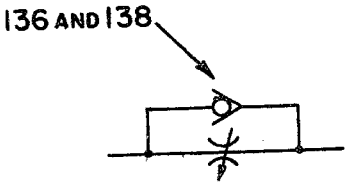
FIG. 5A is a schematic of the restrictor valve used in the system to control surge on the push cables and the rig.
Figure 5:
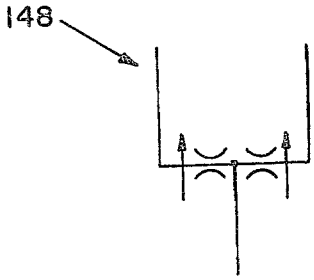
FIG. 5 is a schematic of the 50/50 flow divider utilized in the system.

Referring now to FIG. 5, there is shown a schematic of the 50/50 flow divider regulator 148 which is used on the mechanical system to allow a single pump to do the work of what normally would be done by two pumps.

Referring now to FIG. 5A, there is shown a schematic of the restrictor valves 136 and 138 used in the system to control surge on the push cables and the rig.

Figure 6:
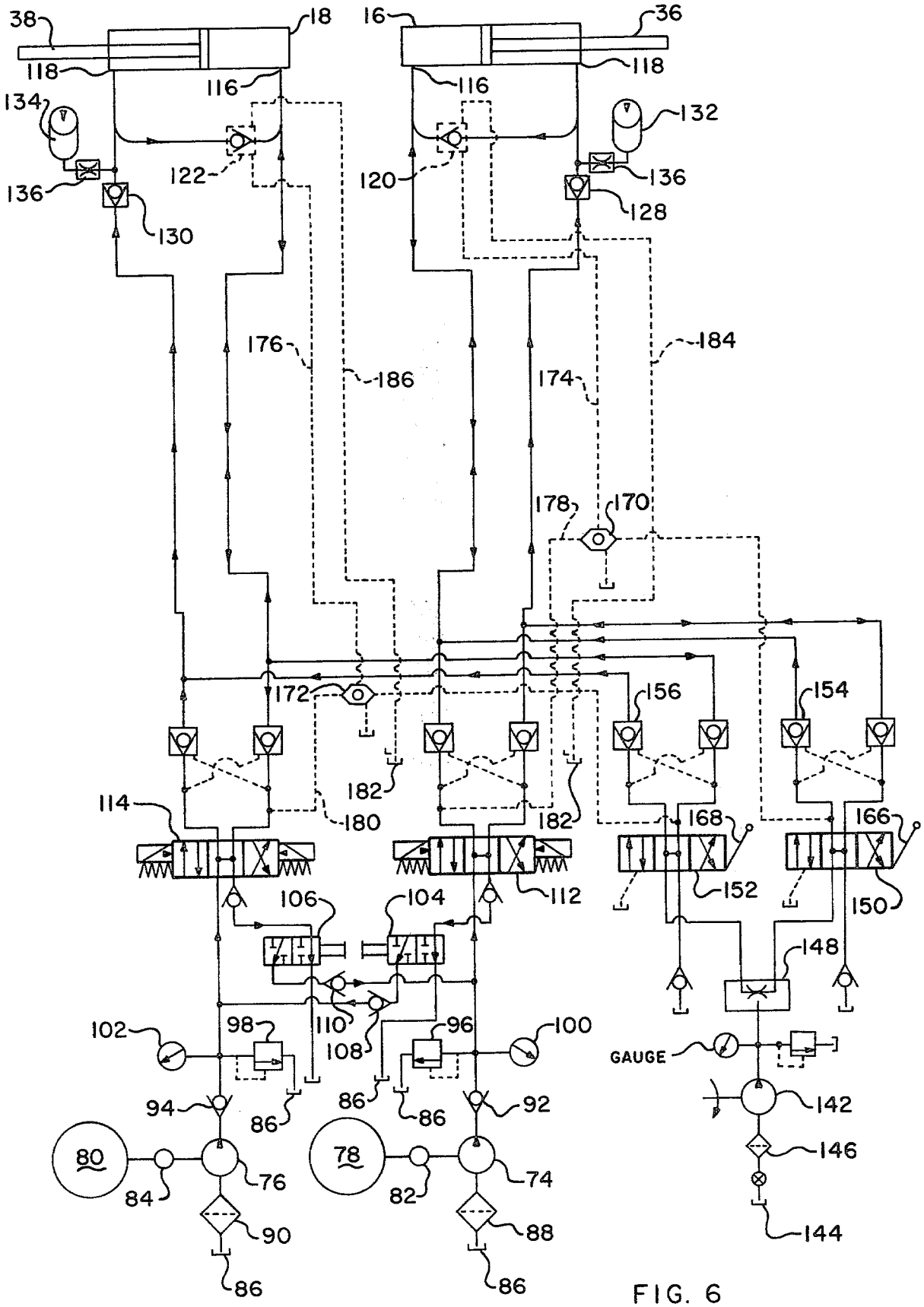
FIG. 6 is a schematic of a modification of the preferred embodiment shown in FIG. 3 of the drawings.

Referring now to FIG. 6 of the drawings there is shown a schematic of a modification of the preferred embodiment shown in FIG. 3 of the drawings wherein the pilot-operated, check valves 120 and 122 as shown in FIG. 3 have been modified to give a faster closing of the check valve. This is accomplished by providing in the circuitry, as shown in FIG. 6, shuttle valves 170 and 172 connected to the pilot operated, check valves 120 and 122 by means of the first pilot pressure lines 174 and 176. In addition the shuttle valves 170 and 172 are also connected to the electric pilot-operated control valves 112 and 114 by means of a second pilot pressure line 178 and 180. Each pilot-operated check valve 120 and 122 is also connected directly to the system tank or sump 182 by means of a drain line 184 and 186 to thereby allow a faster closing of the pilot-operated, check valves.

When this modification is utilized in the basic system, the shuttle valves 170 and 172 would be located on the tug operating panel which would result in a less complicated installation since the necessary plumbing for the shuttle valves would be done on the control panel. In adddition this arrangement would not require large hydraulic lines to be worked on in the vessel, resulting in less chance of contamination of the main lines and holding down the cost of installation. A further improvement in using the modification shown in FIG. 6 would be minimizing the chance of larger hydraulic lines being in a pressure balance situation, which would delay closing of the pilot-operated check valves.

For simplicity purposes the remaining components of FIG. 6 will not be described in detail in as much as they basically function in a manner similar to the same or slightly different components in FIG. 3 of the drawing, in keeping with accepted hydraulic utilization of these components. Modifications may of course be made in the various components between the FIG. 3 embodiment and the FIG. 6 modification, and it is within the spirit and scope of the invention that the invention is not to be limited to the schematics shown.

When the subject hydraulic quick release system is utilized for tightening and releasing tug and barge cable connections, the system provides an ideal way to handle unmanned barges which is in addition safe to the operating personnel on the tug. Tow rigs such as are contemplated for use with the invention are operated in coastal towing by push means with the hawser connected to the barge, so that in the event of bad weather the tug can break loose from push towing to hawser towing without any danger to operating personnel. By running a wire pendant from the bow of the barge down the deck, held with lashing, to the bow of the tug and with the tow wire being run on the other side of the tug and connected to the pendant, the captain of the tug is then able to stop the tug and release the push wires. Thereafter he is free to go around to the pendant side of the barge, slowly breaking the lashing which enables him to move out ahead of the barge and go to a pulling mode, with the crewmen slacking the two cables to desired lengths allowing the tow to get underway.

From the foregoing it can be seen that many modifications may be made in the basic system and the arrangement of components without departing from the spirit and scope of the invention, and the invention is not to be limited to the embodiments shown which have been shown for purposes of illustration only.

Having described my invention, I claim:

1. An improved hydraulic, quick release system for tightening and releasing tug-to-barge cable connections, comprising:

(a) a pair of hydraulic cylinders having barge cable connections associated therewith mounted on the stern of the tug with one cylinder being mounted toward each side of the tug;

(b) attaching means for attaching the barge cable connections to said hydraulic cylinders to quickly and easily attach and release the barge cables with respect to said cylinders as desired;

(c) actuating means, associated with each said cylinder, for actuating said cylinders simultaneously and independently to tighten and loosen the cable connections as desired;

(d) by-passing means, associated with said actuating means, for by-passing the independent actuation of each said cylinder as required by conditions;

said by-passing means comprising a pair of selector valves hydraulically connected to simultaneously independently tighten and loosen the cable connections upon failure of said actuating means, said pair of selector valves also being utilized to independently actuate each said cylinder in turn as desired;

(e) control means, associated with said actuating means and said hydraulic cylinders, for controlling the actuation of said cylinders by said actuating means to actuate said cylinders to tighten the barge cable connections and also to loosen the connections as desired; and (f) increasing means, associated with said pair of cylinders, for increasing the extending speed of said cylinders to quickly release the cables from said cylinders when desired by a quick retraction of said cylinders.

2. An improved hydraulic, quick release system with sump for tightening and releasing tug-to-barge cable connections, comprising:

(a) a pair of hydraulic cylinders having barge cable connections associated therewith mounted on the stern of the tug with one cylinder being mounted toward each side of the tug;

(b) attaching means for attaching the barge cable connections to said hydraulic cylinders to quickly and easily attach and release the barge cables with respect to said cylinders as desired;

(c) actuating means, associated with each said cylinder, for actuating said cylinders simultaneously and independently to tigthen and loosen the cable connections as desired;

(d) by-passing means, associated with said actuating means, for by-passing the independent actuation of each said cylinder as required by conditions;

(e) control means, associated with said actuating means and said hydraulic conditions, for controlling the actuation of said cylinders by said actuating means to actuate said cylinders to tighten the barge cable connections and also to loosen the connection as desired;

(f) increasing means, associated with said paid of cylinders, for increasing the extending speed of said cylinders to quickly release the cables from said cylinders when desired by a quick retraction of said cylinders;

(g) an auxiliary pump and motor connected to the sump and operatively connected to said hydraulic cylinders; and (h) manual control means, associated with said auxiliary pump and motor, for manually controlling the flow of hydraulic fluid from the sump to said hydraulic cylinders in an emergency in the event said actuating means fails.

3. An improved hydraulic, quick release system for tightening and releasing tug-to-barge cable connections, comprising:

(a) a pair of hydraulic cylinders having barge cable connections associated therewith mounted on the stern of the tug with one cylinder being mounted toward each side of the tug;

(b) attraching means for attaching the barge cable connections to said hydraulic cylinders to quickly and easily attach and release the barge cables with respect to said cylinders as desired;

(c) actuating means, associated with each said cylinder, for actuating said cylinders simultaneously and independently to tighten and loosen the cable connections as desired;

(d) by-passing means, associated with said actuating means, for by-passing the independent actuation of each said cylinder as required by conditions;

(e) control means, associated with said actuating means and said hydraulic cylinders, for controlling the actuation of said cylinders by said actuating means to actuate said cylinders to tighten the barge cable connections and also to loosen the connections as desired; said control means comprising a pair of electric, pilot-operated control valves; and (f) increasing means, associated with said pair of cylinders, for increasing the extending speed of said cylinders to quickly release the cables from said cylinders when desired by a quick retraction of said cylinders; said increasing means comprising a pair of pilot-operated, check valves placed in close proximity to said pair of hydraulic cylinders; said pair of pilot-operated, check valves being connected to said electric pilot-operated control valves by a pair of hydraulic lines.

4. An improved hydraulic, quick release system for tigthening and releasing tug-to-barge cable connections, comprising:

(a) a pair of hydraulic cylinders having barge cable connections associated therewith mounted on the stern of the tug with one cylinder being mounted toward each side of the tug;

(b) attaching means for attaching the barge cable connections to said hydraulic cylinders to quickly and easily attach and release the barge cables with respect to said cylinders as desired;

(c) actuating means, associated with each said cylinder, for actuating said cylinders simultaneously and independently to tighten and loosen the cable connections as desired;

(d) by-passing means, associated with said actuating means, for by-passing the independent actuation of each said cylinder as required by conditions;

(e) control means, associated with said actuating means and said hydraulic cylinders, for controlling the actuation of said cylinders by said actuating means to actuate said cylinders to tighten the barge cable connections and also to loosen the connections as desired; and (f) increasing means, associated with said pair of cylinders, for increasing the extending speed of said cylinders to quickly release the cables from said cylinders when desired by a quick retraction of said cylinders; said increasing means comprising a pair of pilot-operated, check valves placed in close proximity to said pair of hydraulic cylinders, a shuttle valve, a first pilot pressure line, a sump tank and a drain line, said shuttle valve connecting each said pilot-operated, check valve through said first pilot pressure line, each said pilot-operated check valve also being connected directly to said sump tank by said drain line allowing a faster closing of each said pilot-operated, check valve.

5. The system as defined in claim 4, wherein said shuttle valve is located on the tug operating panel.

6. The system as defined in any one of claims 1, 2, 3, or 4, wherein said actuating means comprises a pair of motor operated pumps connected to a hydraulic sump and further comprises said pumps being operatively connected to said cylinders.

7. The system as defined in any one of claims 1, 2, or 4, wherein said control means comprises a pair of electric, pilot-operated control valves.

8. The system as defined in any one of claims 1 or 2, wherein said increasing means comprises a pair of pilot-operated, check valves placed in close proximity to said pair of hydraulic cylinders.

9. The system as defined in claim 2, wherein said manual control means comprises a pair of mechanically operated control valves with relief valves and further comprises a pair of dual, pilot-operated, check valves operatively connected together.

* * * * *

UNITED STATES PATENT AND TRADEMARK OFFICE

CERTIFICATE OF CORRECTION

PATENT NO. : 4,307,678

DATED : December 29, 1981

INVENTOR(S) : BIRNEY A. ROUSSELLE, JR.

It is certified that error appears in the above-identified patent and that said Letters Patent are hereby corrected as shown below:

In the title, change "TUB" to --TUG--;

Signed and Sealed this

*Thirteenth* Day of *July 1982*

[SEAL]

*Attest:*

GERALD J. MOSSINGHOFF

*Attesting Officer*

*Commissioner of Patents and Trademarks*